US005597231A

United States Patent [19]

Rosset

[11] Patent Number: 5,597,231

[45] Date of Patent: Jan. 28, 1997

[54] VARIABLE COLOR LIGHT PROJECTOR

[76] Inventor: James Rosset, Chemin de la Petite-Garenne 18, CH-1214 Vernier, Switzerland

[21] Appl. No.: 446,410

[22] Filed: May 22, 1995

[30] Foreign Application Priority Data

May 24, 1994 [CH] Switzerland ..... 1595/94

[51] Int. Cl.[6] ..... F21P 3/00

[52] U.S. Cl. ..... 362/231; 362/241; 362/293

[58] Field of Search ..... 362/231, 237, 362/240, 241, 293; 355/37, 70, 71

[56] References Cited

U.S. PATENT DOCUMENTS

| | | | |
|---|---|---|---|
| 3,825,335 | 7/1974 | Reynolds | 355/37 |
| 4,914,556 | 4/1990 | Richardson | 362/293 |
| 5,031,078 | 7/1991 | Bornhorst | 362/293 |

FOREIGN PATENT DOCUMENTS

| | | |
|---|---|---|
| 786289 | 7/1972 | Belgium . |
| 3634156 | 10/1986 | Germany . |
| 2060852 | 9/1979 | United Kingdom . |

*Primary Examiner*—Ira S. Lazarus
*Assistant Examiner*—Sara Sachie Raab
*Attorney, Agent, or Firm*—Ostrolenk, Faber, Gerb & Soffen, LLP

[57] ABSTRACT

A light projector, which makes it possible to change the light colors and their intensities instantaneously, comprises a series of at least three lamps supplied by three circuits controlled from a control panel comprising three selectors. Depending on the variant, there are either three dichroic lamps of different colors, or white lamps with which dichroic filters of colors A, B and C are associated. The disclosure concerns the elements supporting the lights in an enclosure.

30 Claims, 3 Drawing Sheets

VARIABLE COLOR LIGHT PROJECTOR

BACKGROUND OF THE INVENTION

The present invention relates to the field of lighting and more particularly relates to a variable color light projector used, for example, on a stage for performing shows.

Devices which allow variable lighting effects and use color filters arranged in a white light beam have long been known. For example, use of a disc comprising a series of filters arranged in a ring around a rotational shaft driven by a motor makes it possible to position a filter of the desired color in the light beam emitted by a projector. The choice of colors is limited to five or six filters, in most cases. Another drawback is that it is unavoidably necessary to pass through the color or colors that are arranged between the successive filters chosen.

Another known device makes it possible to superpose filters in the light beam, but it has the drawback of a significant loss of intensity.

A system has more recently been developed which uses color gelatins of square shape which form a strip, and each end of the strip is fixed to a motorized roller. By advancing the strip from left to right, or vice versa, the desired color light is obtained. It is therefore necessary to pass through all the intermediate colors in order to obtain the one located at the end of the strip.

All the devices described so far have the further drawback of producing a relatively large amount of noise because of their use of motor mechanisms for advancing the colors.

Finally, a device is known which comprises a set of filters and dichroic mirrors arranged in the light beam of three lamps, one mounted in the axis of the projector and the others radially with respect to this axis, respectively. This apparatus makes it possible to reproduce any desired color instantaneously because it allows mixing. However, it has the drawback of low luminosity, because of the superposition of the filters and of the dichroic mirrors in the actual body of the apparatus. Because of the high temperature reached by known devices, it is not possible to increase their intensity because the electronic parts do not withstand a temperature above 80° C.

SUMMARY OF THE INVENTION

The object of the present invention is to overcome the drawbacks of apparatus mentioned above. Its subject is a variable color light projector, which comprises at least: a series of three (dichroic) lamps, the light beams of which are substantially parallel, three supply circuits for the lamps and three control devices for the supply circuits.

Instead of using lamps of different colors, a series of three color filters may be associated with respective ones of a series of three white lamps.

Without departing from the scope of the present invention, an additional white lamp may be included, in front of which no filter is arranged.

In a preferred embodiment described in detail below, two sets of three filters are arranged in front of six corresponding lamps. Two sets of filters of blue, green and red color may advantageously be chosen, wherein one of the sets is darker in shade than the other, or alternatively two sets of three identical colors may be chosen.

It should furthermore be noted that the lighting device according to the invention is designed to be arranged inside a commercial projector, so that it can be used easily as a replacement for a conventional bulb in any known device, for example a pivoting stage projector equipped with a conventional motorized device.

Other features and advantages of the present invention will become apparent from the following description of the invention which refers to the accompanying drawings.

BRIEF DESCRIPTION OF THE DRAWINGS

The attached drawing represents one embodiment of the subject of the present invention by way of a non-limiting example.

More precisely, FIG. 4 represents the part for supporting the device in the body of the projector.

FIG. 5 is a view of the grille for positioning the lamps.

FIG. 6 represents the lower plate of the body of the device according to the invention.

FIG. 7 shows the plate supporting the supply sockets, which is arranged inside the actual body of the apparatus.

FIG. 8 represents the upper plate of the body, comprising, on the one hand, the electrical power point for the lamps and the means for fastening a fan.

DETAILED DESCRIPTION OF EMBODIMENTS OF THE INVENTION

Figure 1:
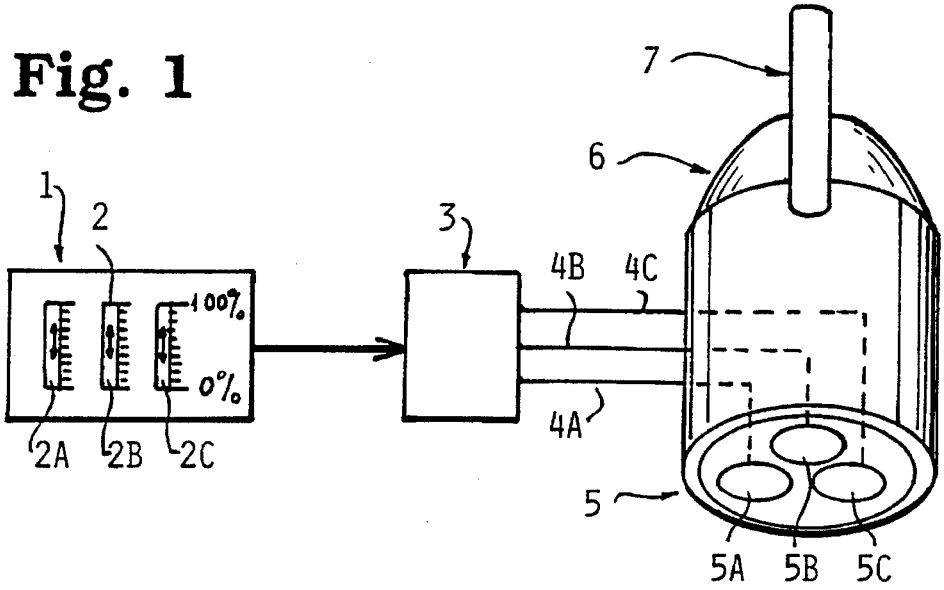
FIG. 1 is a block diagram of a projector equipped with a three-lamp device according to the invention, with its control panel and a supply box.

In the block diagram of FIG. 1, a control panel 1 has been represented as comprising three variators 2 making it possible to apportion colors on scales from 0 to 100% intensity for each color. More precisely, the variators 2A, 2B and 2C respectively correspond to the colors A (for example green), B (red) and C (blue).

The controls are sent into a power variator 3 comprising at least three supply circuits 4A, 4B and 4C for the three lamps 5A, 5B and 5C of colors A, B and C respectively, which are arranged in a projector 6 which is, in the conventional manner, provided with orientation means 7.

The lamps 5 are dichroic color lamps. Depending on the supply power reaching each of them, the desired intensity and color can be obtained at the output of the projector 6.

In the block diagram of FIG. 1, a conventional control panel has been schematized, but it is of course possible to carry out all these controls through use of a computer, and to store successive cycles or predetermined sequences in a manner known to a person skilled in the art, in order to vary the colors as a function of a preestablished sequence.

Figure 2:
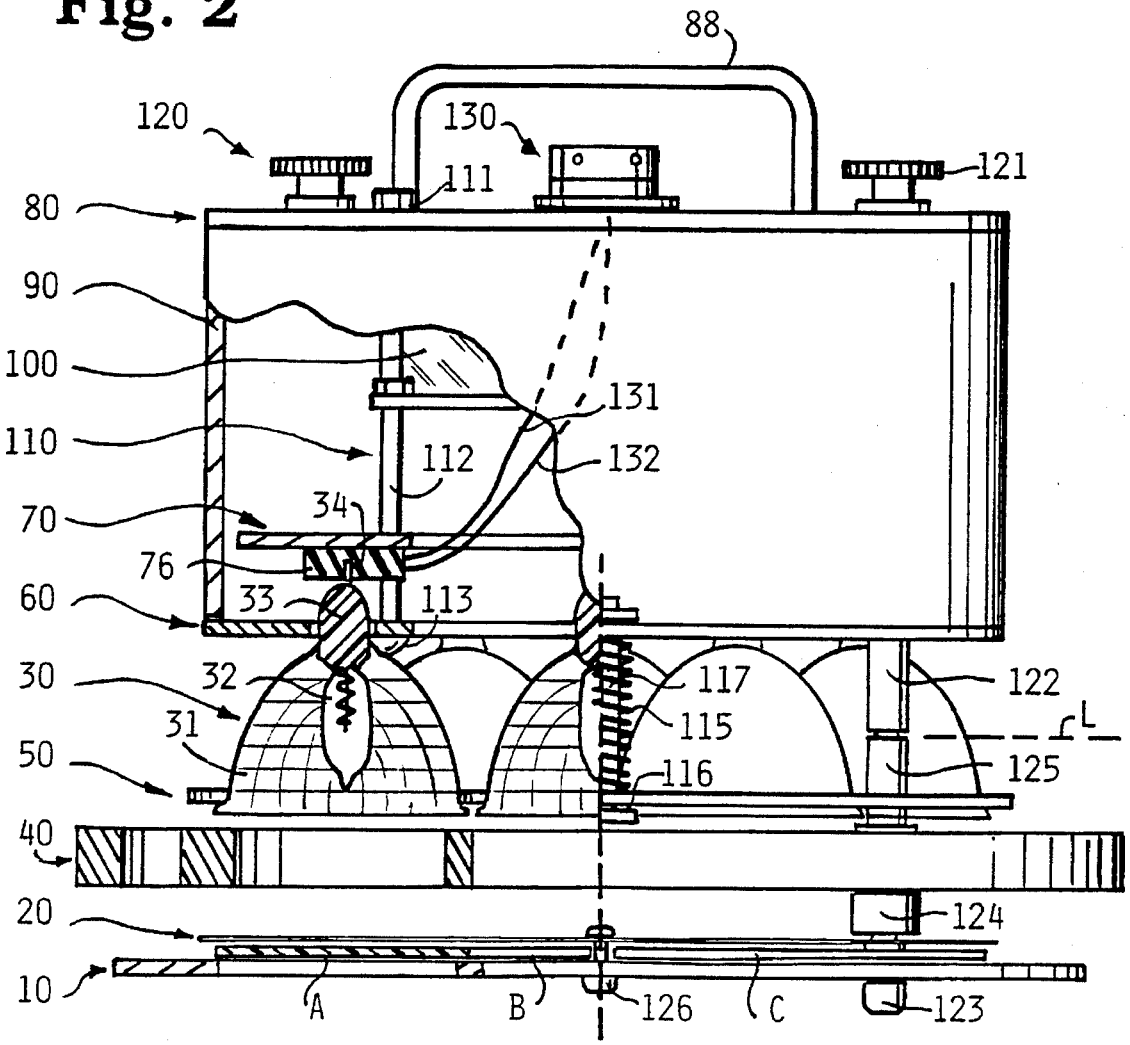
FIG. 2 is a side view of a lighting device, seen partially in section, showing the arrangement of the main components in a variant having two sets of three white lamps provided with color filters.

FIG. 2 shows a preferred mode of assembly of the device according to the invention, seen in profile, with a partial section through the elements in the left-hand part of the Figure. The device is of cylindrical general shape, so that it can be used in a conventional theater projector.

This embodiment differs from the scheme proposed above in that two groups of three bulbs are used, the lamps are white and are associated with dichroic filters of color A, B and C respectively, and a white lamp is added, the light beam of which is not filtered.

The main components of the device are an outer plate 10 for protecting a series of color filters A, B, C which are held by a spring disc 20. The filters are arranged on the axes of the lamps 30 from which they are separated by a plate 40 which is intended to hold the assembly inside a projector (not shown). A grille 50 holds in place the lamps 30 which pass through an outer closure plate 60 of the cylindrical main body of the device according to the invention and are inserted into sockets fastened on a support plate 70. The main body is closed at its opposite end by an inner closure plate 80. The cylindrical body 90 contains the cooling fan 100 which is fastened by means of screws 110. Clamping means 120 fasten the whole device which is supplied by an electrical power point 130.

Figure 3:
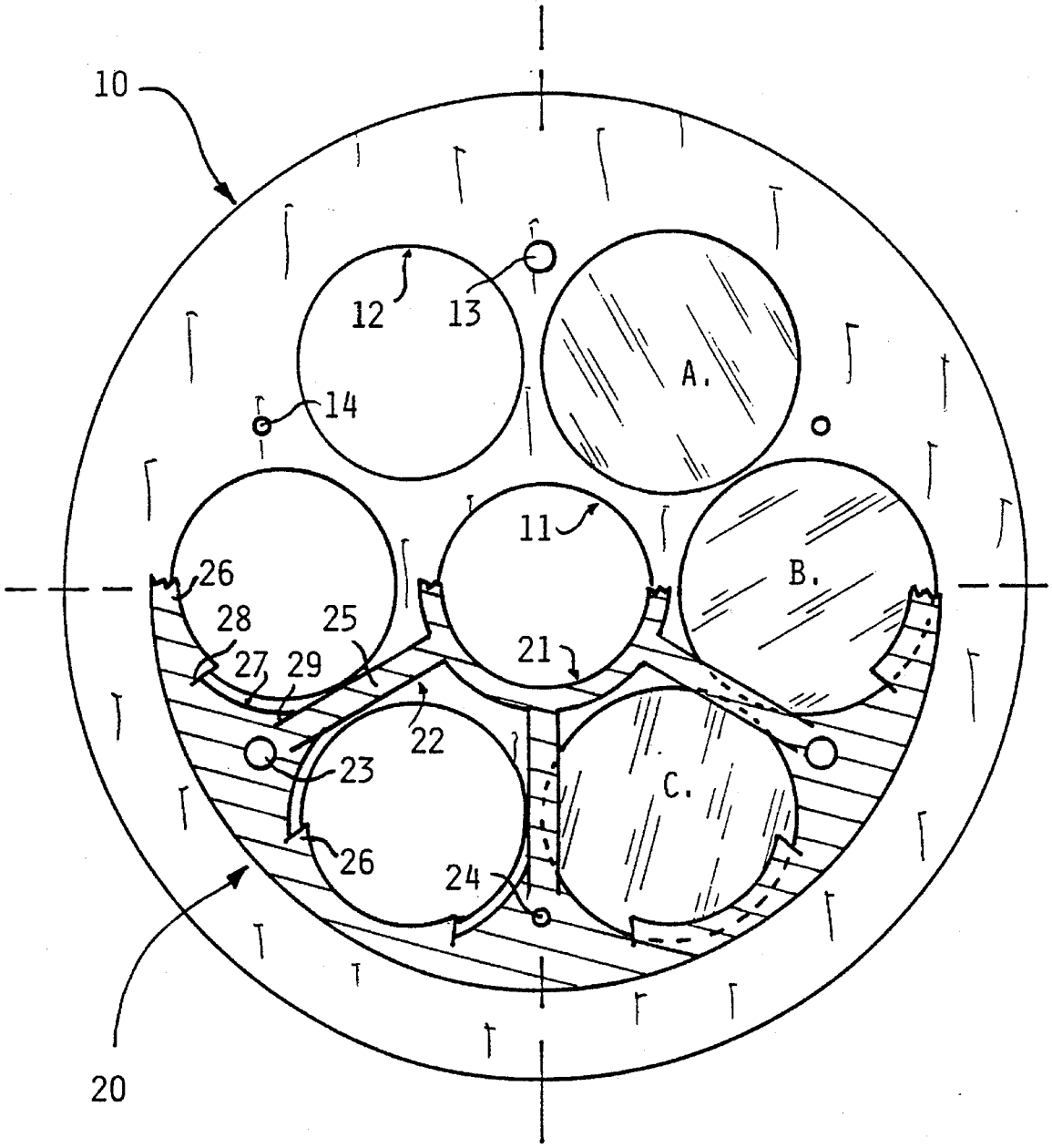
FIG. 3 is a plan view of the filter fastening system, composed of a protective plate and a disc which acts as a spring.

FIG. 3 represents in detail the outer protective plate 10 and, in the lower half of the drawing, the spring disc 20 for holding the color filters A, B, C, the filters being represented only in the right-hand half of FIG. 3. The plate 10 and the spring disc 20 each respectively comprise a central opening 11 or 21 and six openings 12 or 22 equidistant from the center of the assembly, these openings being intended for passage of the light beams output by the lamps 30. Each disc 10 or 20 furthermore comprises three passages 13 or 23 for the fastening means 120 of the assembly, as well as three openings 14 or 24 intended to receive the means for fastening the spring disc 20 onto the outer plate 10.

It is obvious that the openings 12 have a diameter smaller than the diameter of the color filters A, B or C. The particular shape of the six openings 22, bordered by a radial band 25 and an outer tongue 26 which are connected by a circular part 27, the size of which substantially corresponds to that of the filters, will be noted in FIG. 3. The bands 25 and the tongues 26 are made elastic by virtue of the cut-outs 28 and 29 extending these parts and allow the filters to be held, as represented in the lower right-hand part of FIG. 3.

The lamps 30 can be seen in FIG. 2, which schematizes in section a faceted reflector 31, a bulb 32 and a cap 33 for passage of the contacts 34.

Figure 4:
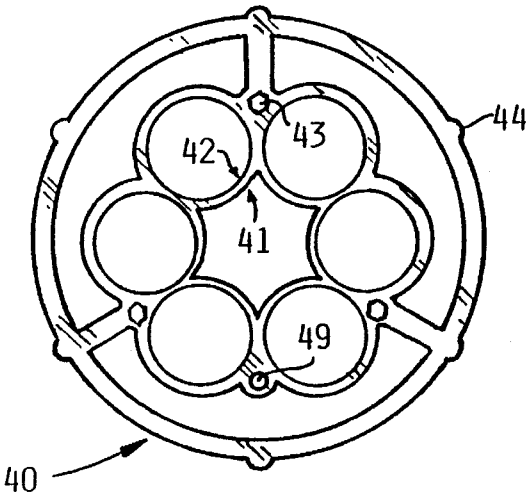

The plate 40 for fastening the assembly inside a conventional projector case is represented in detail in FIG. 4. It is a relatively thick plate comprising a central opening 41 surrounded by six openings 42 for the light beams and by three passages 43 for the fastening means 120. The edge of the plate 40 furthermore comprises a series of protuberances 44 intended to bear on the internal wall of the projector (not shown). The plate 40 advantageously has a cut-out 49 for locating its position with respect to the body of the apparatus, as described below. It will be noted that the plate is cut out to a great extent, in order to allow maximum air circulation and avoid overheating of the assembly.

Figure 6:
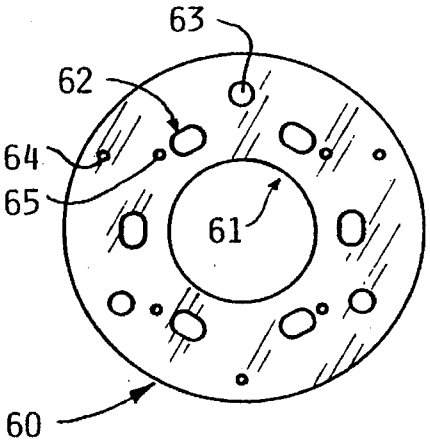
FIGS. 4 to 8 are plan views of the various stages arranged in the projector of FIG. 2, seen on a greatly reduced scale.
Figure 5:
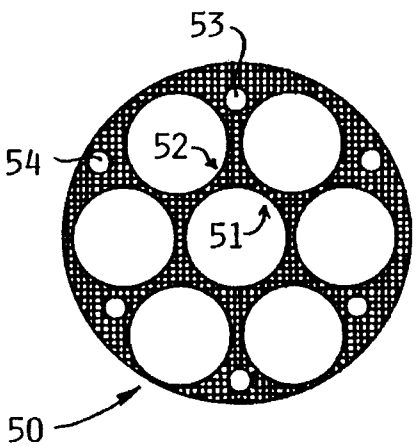

The grille 50 for holding the lamps and the closure plate 60 in FIGS. 5 and 6 both comprise a central opening 51, 61, six openings 52, 62 for passage of the lamps 30, three passages 53, 63 for the means 120 for fastening the assembly and three passages 54, 64 for elastic fastening of the grille 50 with respect to the closure plate 60, as will be seen further on. It will be noted that the central opening 61 has a large diameter in order to allow better removal of the air heated in the cylindrical enclosure 90. It may furthermore have additional ventilation holes (not shown in the drawing). In the proposed embodiment, the closure plate 60 further comprises four passages 65 allowing the cylindrical body 90 to be clamped onto the inner plate 80. It will be noted that the openings 52 and 62 for passage of the lamps are, respectively round, with a diameter corresponding to the reflector 31 and oval, with a size corresponding to the cap 33.

Figure 7:
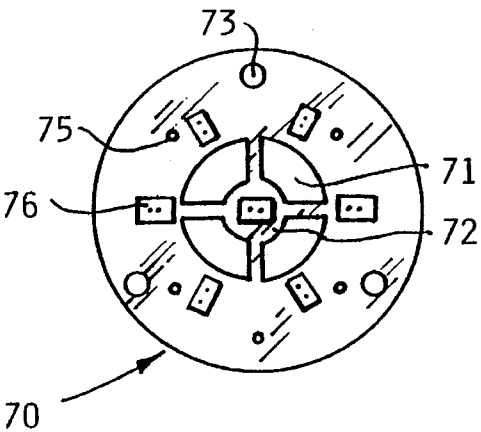

The support plate 70 in FIG. 7 comprises, inside the central opening 71, (for removing the heated air), a solid part 72 on which the supply socket for the central white lamp is fastened. The plate 70 also has three passages 73 for the means for fastening the assembly and four openings 75 for fastening it to the inner closure plate 80. The support 70 makes it possible to fasten, for example using screws (not shown), the supply sockets 76 of the lamps.

Figure 8:
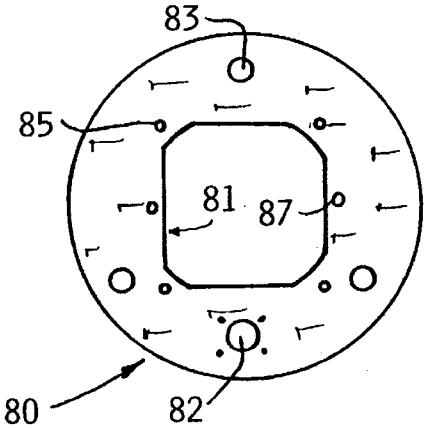

The inner closure plate 80 represented in FIG. 8 comprises a central opening 81, of square general shape, intended to receive the cooling fan 100 which is fastened in the passages 85 provided for this purpose. The closure plate 80 further comprises three passages 83 for the fastening means 120 and an aperture 82 for fastening the electrical power point 130 for supplying the assembly. It may furthermore comprise means 87 for fastening a handle 88 which can be seen in FIG. 2.

As already mentioned, a cylindrical wall 90 is arranged between the outer 60 and inner 80 closure plates in order to form a closed enclosure for receiving the electrical constituents. Each lamp is supplied, independently or in pairs of lamps of the same color, by conductors 131, 132 for connecting to the contactors of the multiple power point 130.

The fan 100 is clamped onto the inner closure plate 80 using fastening means 110. More precisely, referring to the open part of FIG. 2, this fastening 110 can be described by four nuts 111 for fastening the fan 100 in the corresponding passages 85 in the plate 80, and four columns 112 for connection to the support 70, more precisely using the openings 75, and four screws 113 for fastening the closure plate 60, which pass through the openings 65 therein.

These various components are mounted in the cylindrical enclosure, as represented in FIG. 2. Before insertion of the lamps 30, the grille 50 intended to hold them elastically is mounted. For this purpose, three springs 115 are arranged between the outer stops 116 of three columns 117 fixed in the conventional manner in the openings 64 in the closure plate 60. After the grille 50 has been thus mounted, the lamps 30 can be fastened.

Provision may be made to replace one of the columns 117 with a longer column intended to pass through the cut-out 49 in the plate 40 which makes it possible to position the color filters A, B and C facing the corresponding lamps. Although it is not shown in the drawing, this longer column may also pass through the passages made in the protective plate 10 and the spring disc 20.

The clamping means 120 which fasten the whole of the device comprise three columns intended to pass freely through the passages 63, 73 and 83. Each comprises a knurled inner part 121 and a tapped outer part 122 projecting out of the closure plate 60. These columns are held inside the cylindrical body in a known manner.

While the lamps 30 and the grille 50 remain fastened on the cylindrical body of the device, the other elements (including the plate 10 for protecting the filters, spring disc 20 and holding plate 40) form a removable assembly starting from the line L. This assembly is assembled by means of three screws 123 passing successively through the passages 13 and 23, spacers 124, the passages 43 in the plate 40, before being screwed into the stubs 125, out of which the screws 123 project in order to cooperate with the tapped part 122 of the columns 120.

In the embodiment represented in the drawing, it is inevitably necessary to separate the separable assembly from the rest of the apparatus in order to change the bulbs. If one or more filters must be changed, it is necessary to unscrew the three knurled parts 121, withdraw the components located short of the line L, unscrew the screws 123 for assembling the protective plate 10 onto the holding plate 40, then separate the protective plate 10 from the spring disc 20 by acting on the bolts 126 arranged in the openings 13 and 23 in these components.

Because of the high temperatures reached during extended periods of use, in particular when the device according to the invention is introduced into the body of a conventional projector, metallic components are advantageously used. It will furthermore be expedient to protect the fan by using materials which prevent the conduction of heat.

The description which has just been given of the embodiment represented in the drawing does not imply limitation, and constructional variants will be clearly apparent to the person skilled in the art desiring to implement the subject of the invention. By way of example, instead of the device described, which is designed to be inserted into a conventional projector housing, an apparatus may be constructed directly in an independent casing.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A variable color light projector comprising:

at least three lamps each capable of projecting a light beam, and the lamps being oriented so that respective light beams thereof are projected substantially parallel;

at least a set of three color filters positioned relative to the lamps to supply color to the respective beams of light from the lamps;

three supply circuits, each respectively for one of the lamps;

three control devices, each for a respective one of the supply circuits; and a white light lamp disposed in a central position to the three lamps, with an independent supply circuit and control device.

2. The projector of claim 1, wherein each of the lamps is a white light lamp.

3. The projector of claim 2, further comprising an outer protective plate below and a spring disk above the outer protective plate and the filters being elastically clamped between the outer protective plate and the spring disk, the outer protective plate being below and in the beams of light from the lamps;

a support plate for the projector, and the support plate having protuberances intended for bearing on an internal wall of a casing of the projector, the support plate retaining sockets for the lamps including passages therethrough the clamping means for fastening both plates and the projector together.

4. The projector of claim 3, wherein the plates includes openings therein for the passages of the lamps and the light beams from the lamp.

5. The projector of claim 3, wherein the plate includes passages therethrough, and clamping means which fasten the plate and projector and pass through the passages.

6. The projector of claim 1, comprising an additional set of three color filters, and three additional lamps with a respective one of the lamps for each of the filters, and wherein each of the filters being disposed in front of each of the lamps.

7. The projector of claim 6, wherein the filters of one of the sets are darker in shade than the filters of the other set.

8. The projector of claim 6, wherein the color filters are respectively blue, green and red.

9. The projector of claim 6, including a cylindrical body and an inner closure plate and an outer closure plate which are spaced apart and defining an enclosure in the cylindrical body; a cooling fan for the lamps located within the body, the lamps in part communicating into the body; components connectable to an electrical power point and connected to the respective supply circuits.

10. The projector of claim 9, further comprising a support plate within the body, and lamps having respective sockets for supplying the lamps and the sockets being contained and supported in the support plate.

11. The projector of claim 9, further comprising a support plate within the body, and the plate having respective sockets for supplying the lamps and the sockets being contained and supported in the support plate.

12. The projector of claim 11, further comprising a plate below and a spring disk above the plate and the filters being elastically clamped between the plate and the spring disk, the plate being below and in the beams of light from the lamps;

a support plate for the projector, and the support plate having protuberances intended for bearing on an internal wall of a casing of the projector, the support plate retaining sockets for the lamps;

the plate and the support plate all including passages therethrough and clamping means for fastening the various plates and the projector together.

13. The projector of claim 12, wherein the plate includes passages therethrough, and clamping means which fasten the plate and projector and pass through the passages.

14. The projector of claim 12, further comprising a support plate with in the body, and lamps having respective sockets for supplying the lamps and the sockets being contained and supported in the support plate, wherein the support plate in the body and a grill each includes openings therein for passage of the lamps and the light beams.

15. The projector of claim 1, further comprising a support plate for the projector, and the plate having protuberances intended for bearing on an internal wall of a casing of the projector, the support plate retaining sockets for the lamps.

16. The projector of claims 1, wherein each of the lamps includes a respective reflector for directing the light beams parallel;

a grill for elastically holding the reflectors.

17. A variable color light projector comprising:

at least three lamps each capable of projecting a light beam, and the lamps being oriented so that the respective light beams thereof are projected substantially parallel, each of the lamps is a white light lamp;

three supply circuits, each respectively for one of the lamps;

three control devices, each for a respective one of the supply circuits;

a respective color filter positioned in front of each of the lamps for supplying color to the respective beam of light from each lamp;

an additional white light lamp with a respective independent supply circuit and a respective control device; and an additional set of three color filters, and three additional lamps with a respective one of the lamps for each of the filters, and wherein each of the filters being disposed in front of each of the lamps.

18. The projector of claim 17, wherein the filters of one of the sets are darker in shade than the filters of the other set.

19. The projector of claim 17, wherein the color filters are respectively blue, green and red.

20. The projection of claim 17, including a cylindrical body and an inner closure plate and an outer closure plate which are spaced apart and defining an enclosure in the cylindrical body; a cooling fan for the lamps located within the body, the lamps in part communicating into the body; components connectable to an electrical power point and connected to the respective supply circuits.

21. The projector of claim 20, further comprising a plate within the body, and lamps having respective sockets for supplying the lamps and the sockets being contained and supported in the support plate.

22. The projection of claim 20, further comprising a support plate within the body, and the plate having respective sockets for supplying the lamps and the sockets being contained and supported in the support plate.

23. The projector of claim 22, further comprising a plate below and a spring disk above the plate and the filters being elastically clamped between the plate and the spring disk, the plate being below and in both beams of light from the lamps;

a support plate for the projector, and the support plate having protuberances intended for bearing on an internal wall of a casing of the projector, the support plate retaining sockets for the lamps;

the plate and the support plate all including passages therethrough and clamping means for fastening the various plates and the projector together.

24. The projector of claim 23, wherein the plate includes passages therethrough, and clamping means which fasten the plate and projector and pass through the passages.

25. The projector of claim 23, further comprising a support plate within the body, and lamps having respective sockets for supplying the lamps and the sockets being contained and supported in the support plate, wherein the support plate in the body and a grill each includes openings therein for passage of the lamps and the light beams.

26. The projector of claim 17, further comprising a support plate for the projector, and the plate having protuberances intended for bearing on an internal wall of a casing of the projector, the support plate retaining sockets for the lamps.

27. The projector of claim 17, wherein each of the lamps includes a respective reflector for directing the light beams parallel;

a grill for elastically holding the reflectors.

28. The projector of claim 17, further comprising a plate below and a spring disk above the plate and the filters being elastically clamped between the plate and the spring disc, the plate being below and in the beams of light from the lamps;

a support plate for the projector, and the support plate having protuberances intended for bearing on the internal wall of a casing of a projector;

the plate and the support plate all including passages therethrough and clamping means for fastening the various plates and the projector together.

29. The projection of claim 28, wherein the plate includes passages therethrough, and clamping means which fasten the plate and projection and pass through the passages.

30. The projector of claim 28, wherein the plates includes openings therein for the passages of the lamps and the light beams from the lamp.

* * * * *